US005193367A

United States Patent [19]

Ling

[11] Patent Number: 5,193,367

[45] Date of Patent: Mar. 16, 1993

[54] COMBINATION PADLOCK WITH SIDEWARDLY PIVOTED HASP

[76] Inventor: Chong-Kuan Ling, c/o Sinox Co., Ltd., P.O. Box 96-156, Taipei, Taiwan

[21] Appl. No.: 892,972

[22] Filed: Jun. 3, 1992

[51] Int. Cl.[5] ..... E05B 37/02

[52] U.S. Cl. ..... 70/28; 70/312

[58] Field of Search ..... 70/22, 28, 317, 312, 70/27, 315-316, 318-319

[56] References Cited

U.S. PATENT DOCUMENTS

| | | | |
|---|---|---|---|
| 1,712,476 | 5/1929 | Coiro | 70/28 |
| 4,733,548 | 3/1988 | Ling | 70/25 |
| 4,803,856 | 2/1989 | Ling | 70/28 |
| 4,860,561 | 8/1989 | Hwang | 70/28 |
| 5,042,277 | 8/1991 | Jenn-Rong | 70/28 |
| 5,063,761 | 11/1991 | Ling | 70/315 |
| 5,125,248 | 6/1992 | Ling | 70/312 |

FOREIGN PATENT DOCUMENTS

| | | | |
|---|---|---|---|
| 384610 | 11/1923 | Fed. Rep. of Germany | 70/22 |
| 1388099 | 12/1964 | France | 70/28 |

*Primary Examiner*—Richard E. Moore
*Assistant Examiner*—D. Boucher

[57] ABSTRACT

A combination padlock includes a lock body having a hasp fastening member fixedly secured on one side portion of the lock body, a hasp pivotally mounted on the other side portion of the lock body operatively engageable with the hasp fastening member for locking the padlock, a locking bolt longitudinally held in the lock body and resiliently urged to normally bias the hasp for locking the hasp on the fastening member, and a plurality of dials coupled with a plurality of sleeves rotatably mounted in the lock body for operatively locking or unlocking the locking bolt which is in turn actuated to open or close the hasp for unlocking or locking the padlock, thereby providing a sidewardly pivoted hasp with a greater angular pivotal movement of the hasp for a convenient locking or unlocking operation of the padlock.

2 Claims, 5 Drawing Sheets

COMBINATION PADLOCK WITH SIDEWARDLY PIVOTED HASP

BACKGROUND OF THE INVENTION

A conventional combination padlock includes an U-shaped shackle rotatably mounted in a lock body, in which the U-shaped shackle should be pulled outwardly and then rotated for an angle for unlocking a staple locked within the U-shaped shackle, causing an inconvenient unlocking or locking operation for the padlock.

A conventional combination padlock of U.S. Pat. No. 5,042,277 to J. R. Chern discloses a movable lock latch (50) pivotally mounted on a shaft projection (11) formed on an upper side corner of the housing (10) and a lock hook (14) engageable with the movable lock latch (50) for locking the padlock. Whenever unlocking the padlock, the button (31) can be depressed to bias the lock bar (53) inwardly downwardly to separate from the lock hook (14) for opening purpose. However, the lock bar (53) has a free tapered end portion cooperative with another free end portion of the lock hook (14) when locking the padlock but lacking any protective means for shielding the free end portions of the bar (53) and the hook (14), which may be easily broken or damaged by an intruder to thereby lose its locking effect. Meanwhile, when opening the lock, the bar (53) is biased inwardly from the hook (14) with only a small opening angle as limited by the protrusions 51, 52 so that it can not be used for locking a staple or an object of larger volume.

The present inventor has found the drawbacks of the conventional padlock and invented the present combination padlock with a hasp pivotally biased sidewardly at a large angle.

SUMMARY OF THE INVENTION

The object of the present invention is to provide a combination padlock including a lock body having a hasp fastening member fixedly secured on one side portion of the lock body, a hasp pivotally mounted on the other side portion of the lock body operatively engageable with the hasp fastening member for locking the padlock, a locking bolt longitudinally held in the lock body and resiliently urged to normally bias the hasp for locking the hasp on the fastening member, and a plurality of dials coupled with a plurality of sleeves rotatably mounted in the lock body for operatively locking or unlocking the locking bolt which is in turn actuated to open or close the hasp for unlocking or locking the padlock, thereby providing a sidewardly pivoted hasp with a greater angular pivotal movement of the hasp for a convenient locking or unlocking operation of the padlock.

DETAILED DESCRIPTION

Figure 1:
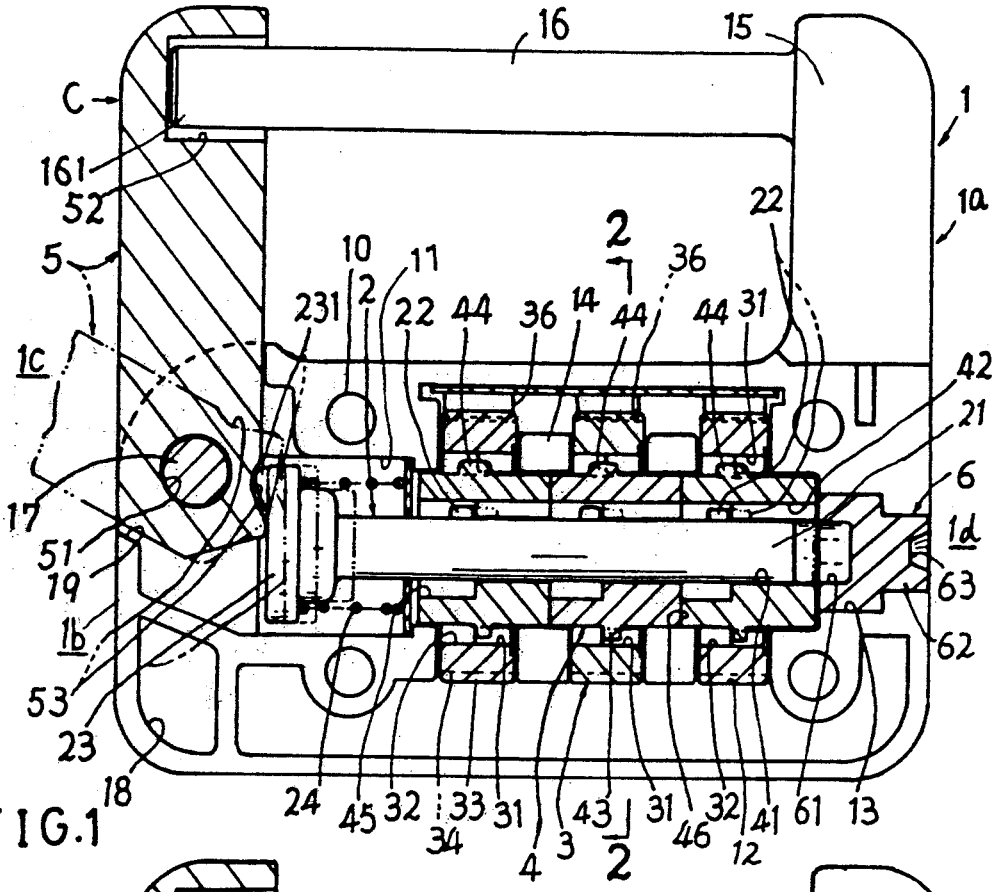
FIG. 1 is a front view sectional drawing of the present invention.

As shown in FIGS. 1–7, the present invention comprises: a lock body 1, a locking bolt 2, a plurality of dials 3 and sleeves 4, a hasp 5, and a combination-changing means 6.

The lock body 1 includes: an upper shell 1*a* combined with a lower shell 1*b* with rivets 10 or other connecting means for mounting the elements of the present invention in the lock body 1, a locking bolt chamber 11 recessed in the lock body from a pivotal end portion 1*c* of the lock body 1 for holding the locking bolt 2 therein, a plurality of dial slots 12 longitudinally formed in the lock body 1 for operatively rotating the dials 3 protruding outwardly from the dial slots 12, a socket 13 for mounting the combination-changing means 6 in the socket 13 at a fixed end portion 1*d* of the lock body 1 opposite to the first portion 1*c*, a plurality of projection grooves 14 longitudinally recessed in the lock body 1 each projection groove 14 juxtapositionally adjacent to each dial slot 12, a hasp fastening member 16 generally formed as an elongate rod perpendicularly secured to a base portion 15 perpendicularly protruding upwardly from the lock body 1 for operatively fastening the hasp 5 to form a D shape confined by the hasp 5, the hasp fastening member 16, the base portion 15 and the lock body 1 as shown in FIG. 1, a pivot 17 secured at a first side portion 1*c* of the lock body 1 for pivotally mounting the hasp 5 on the pivot 17, a rope hole 18 formed in the lock body 1 for connecting a plurality of padlocks of the present invention by passing a rope through the rope hole 18, and a hasp hole 19 formed in the first side portion 1*c* of the lock body 1 for the pivotal movement of the hasp 5.

The locking bolt 2 includes: an elongate bolt 21 longitudinally formed in the lock body 1 having a plurality of protrusions 22 longitudinally formed and equally spaced on the elongate bolt 21, a head portion 23 formed on one end of the elongate bolt 21 adjacent to the first side portion 1*c* of the lock body 1, and a bolt restoring spring 24 retained in the locking bolt chamber 11 formed in the lock body 1 for normally urging the head portion 23 sidewardly outwardly towards the first side portion 1*c* of the lock body 1 for biasing the hasp 5 inwardly to be locked with the hasp fastening member 16.

The hasp 5 is formed with a pivot hole 51 in its inner end portion for pivotally mounting the hasp 5 on the pivot 17 of the lock body 1, a hasp socket 52 recessed in an outer end of the hasp 5 for engaging a rod end portion 161 of the hasp fastening member 16 for locking the hasp 5 with the hasp fastening member 16, and an actuating recess portion 53 recessed in an innermost end portion of the hasp 5 to be engageable with an extension block 231 protruding outwardly from the head portion 53 of the locking bolt 2; the actuating recess portion 53 being a force point of a "lever" acted by the extension block 231 of the head portion 23 of the locking bolt 2, the pivot 17 for engaging the pivot hole 51 of the hasp 5 being a fulcrum of the "lever"; and the hasp socket 52 of the hasp 5 being a weight of the "lever", whereby upon an outward forcing on the actuating recess portion 53 as urged by the locking bolt 2 and the restoring spring 24, the hasp socket 52 of the hasp will be biased inwardly to engage the rod end portion 161 of the hasp fastening member 16 about the pivot 17 for closing the hasp 5 on the fastening member 16.

Figure 3:
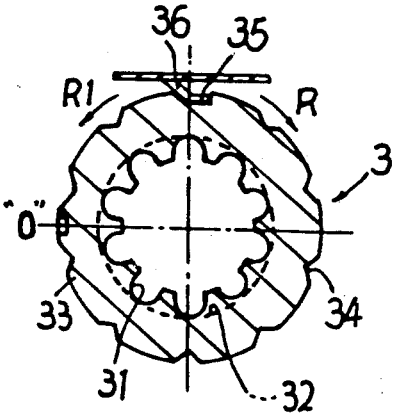
FIG. 3 is a sectional drawing of a dial of the present invention.
Figure 6:
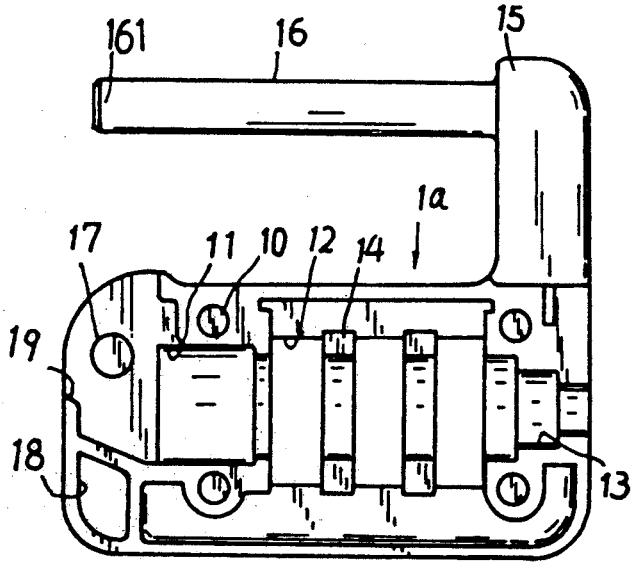
FIG. 6 is an illustration showing an upper shell of a lock body of the present invention.
Figure 7:
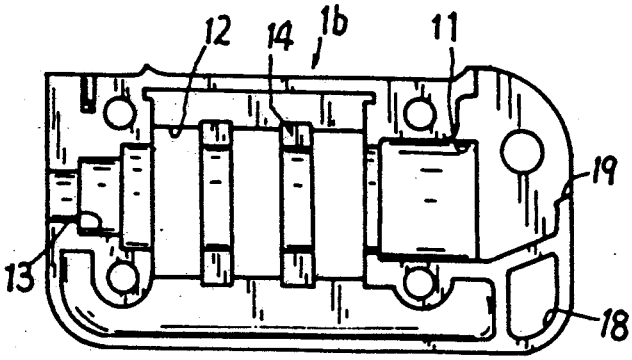
FIG. 7 shows a lower shell of the lock body of the present invention.

Each dial 3 is rotatably mounted in the lock body 1 about a longitudinal axis of the elongate bolt as shown in FIGS. 1, 3 and includes: an inner cylindrical hole 32 formed in a first central portion in the dial 3 facing the first side portion 1*c* of the lock body 1, a plurality of annular recesses 31 annularly formed in a second central portion in the dial 3 facing the second side portion 1*d* of the lock body 1 the annular recesses 31 generally confining an outside diameter slightly smaller than an inside diameter of the inner cylindrical hole 32, a plurality of numerals 33 such as: 0, 1, 2–9 formed on an outer perimeter of each dial 3, a plurality of angular recesses 34 annularly recessed in the outside perimeter of the dial 3 having a single angular recess formed as a ratchet tooth groove 35 and having every numeral 33 defined between every two neighbouring angular recesses 34, a pawl 36 mounted in the lock body and clickingly slidably engageable with each angular recess 34 including the ratchet tooth groove 35 in a clockwise or forward rotation of the dial 3 (direction R as shown in FIG. 3) such as from 0, 1, 2 towards 9 of an arabic number of the numerals 33, but retarding the ratchet tooth groove 35 for preventing a counter-clockwise or backward rotation of the dial 3 (direction R1), with the pawl 36 correspondingly indicating a zero ("0") number of a combination of the padlock, whereby upon a backward rotation of the dial 3 until being retarded by the pawl 36, a zero numeral can be sensed and any desired number can then be obtained by forwardly rotating the dials 3 from the initiating zero number, thereby ensuring an unlocking operation of the lock by sense of feeling even lacking light at night.

Figure 1A:
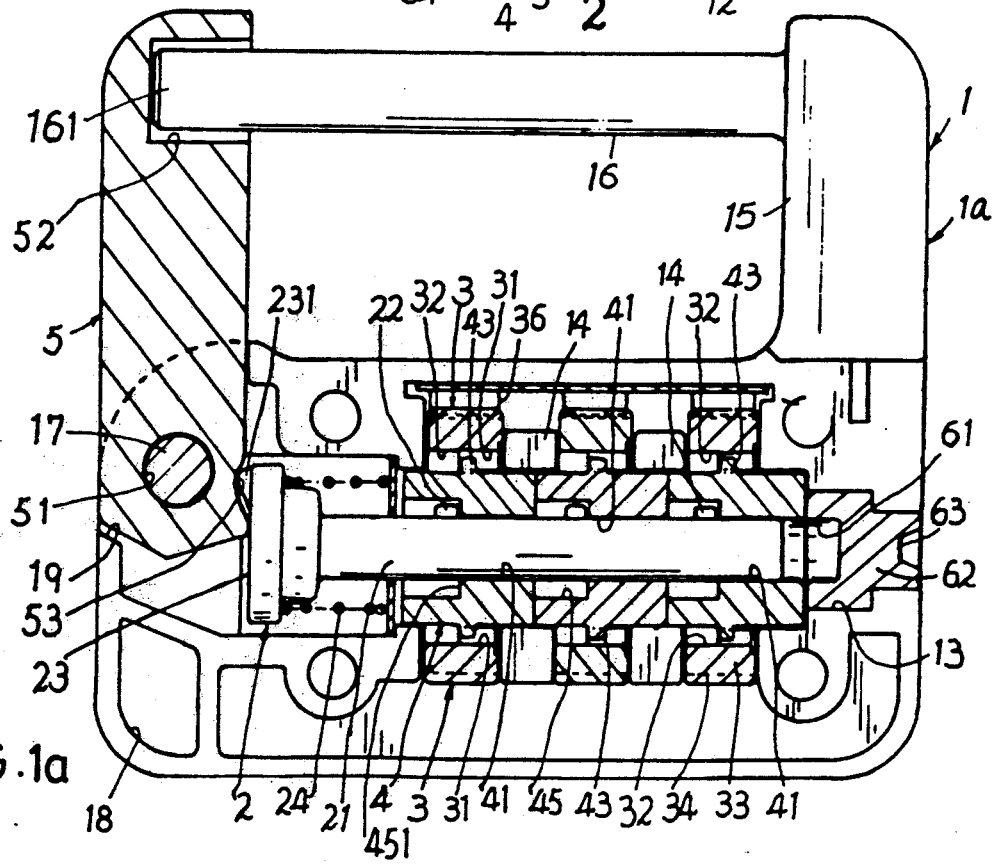
FIG. 1*a* is an illustration showing a locked state of the present invention.
Figure 1B:
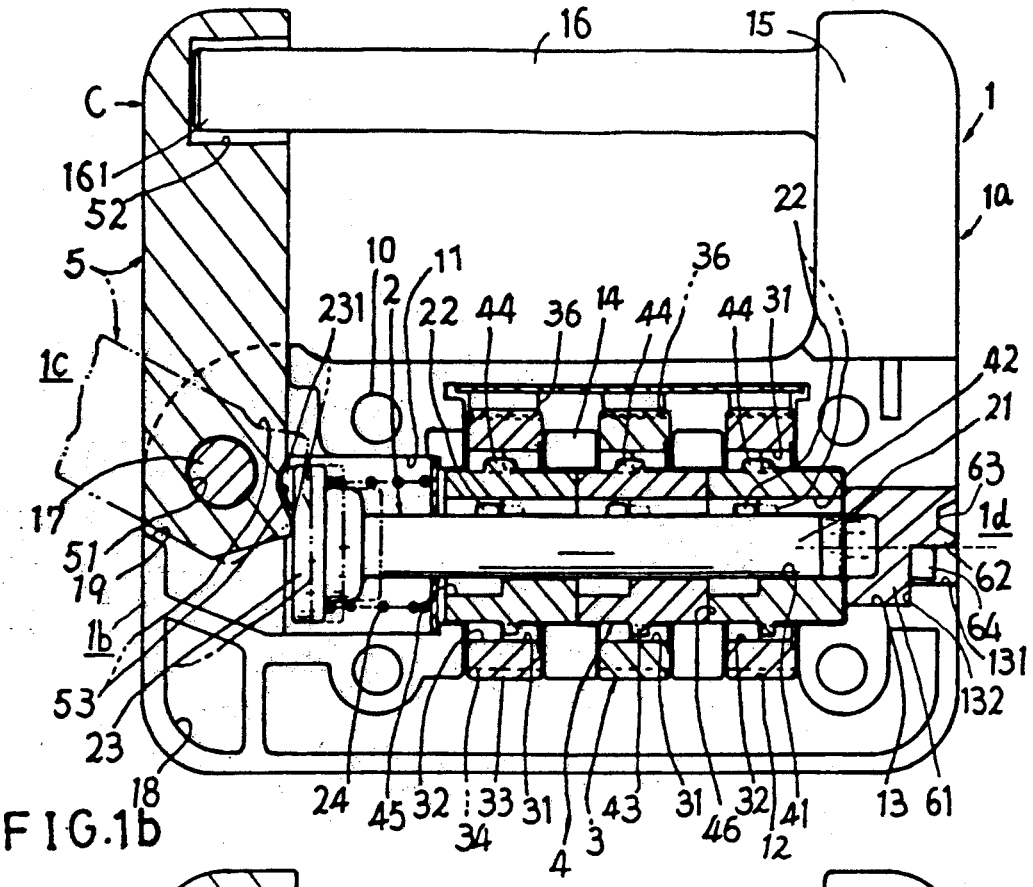
FIG. 1*b* shows another preferred combination-changing means normally held in the present invention.
Figure 1C:
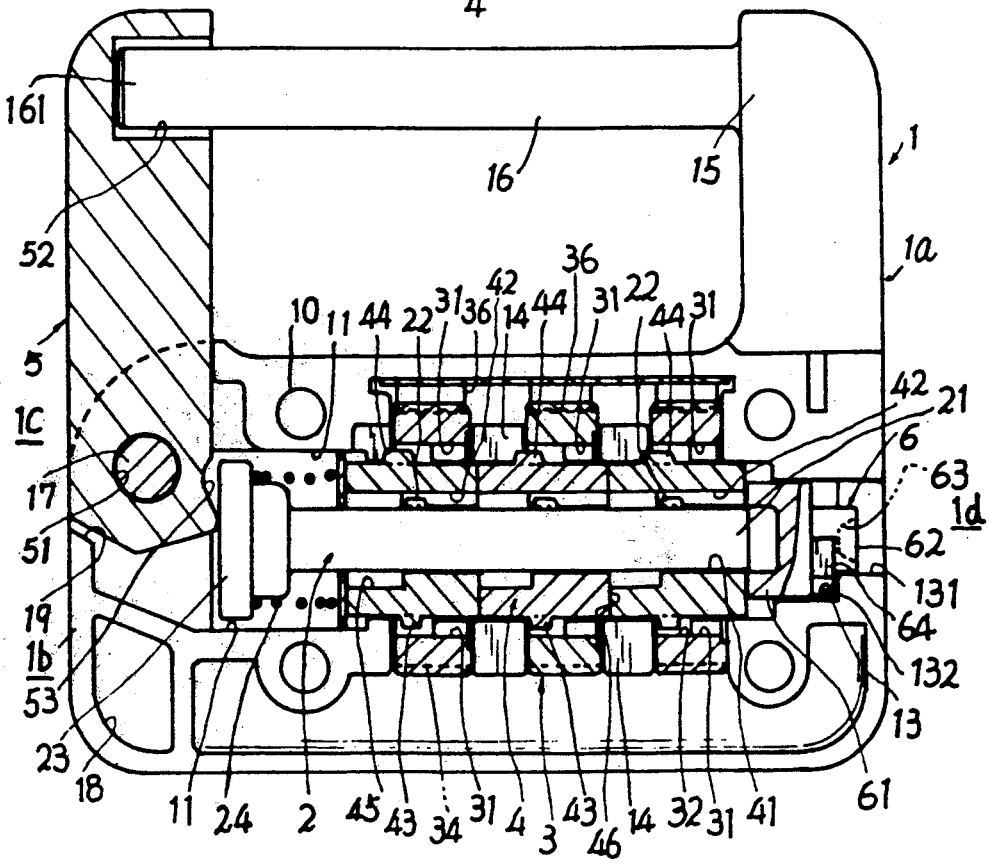
FIG. 1*c* shows a combination-changing operation from FIG. 1*b* of the present invention.
Figure 1D:
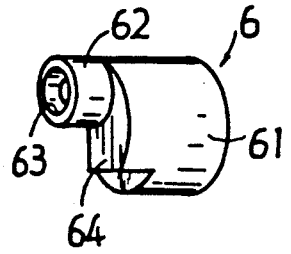
FIG. 1*d* is a perspective view of the combination-changing means as shown in FIG. 1*b*.
Figure 1E:
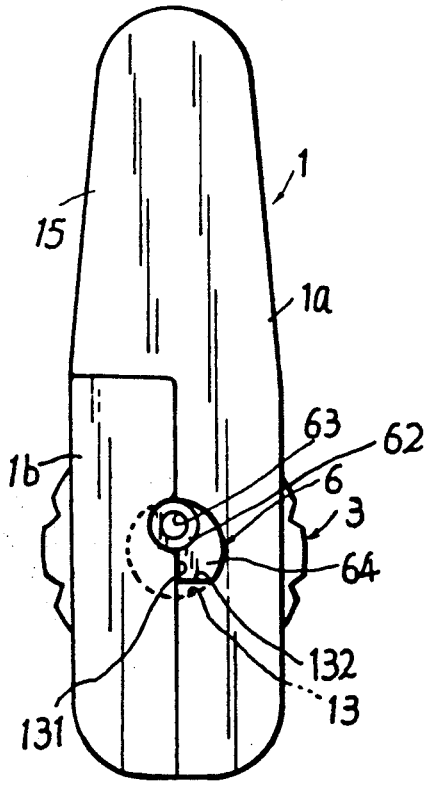
FIG. 1*e* is a right side view of the present invention shown in FIG. 1*b*.
Figure 2:
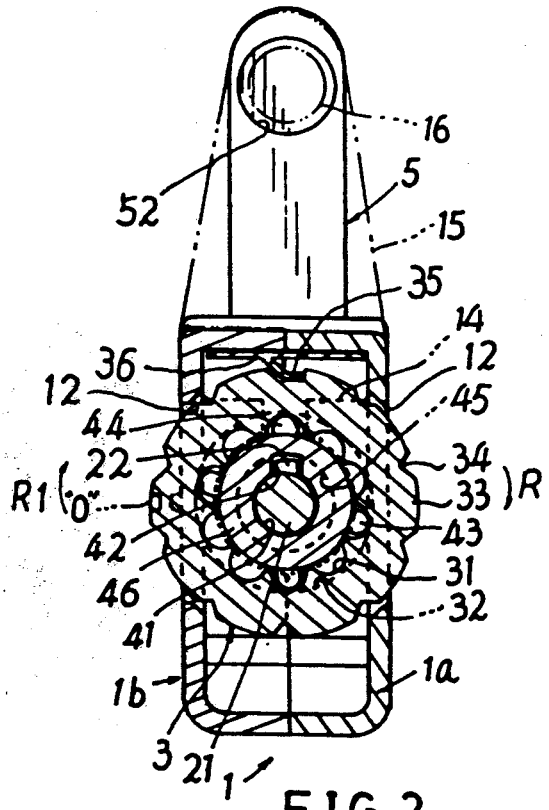
FIG. 2 is a cross sectional drawing of the present invention when viewed from 2—2 direction of FIG. 1.
Figure 4:
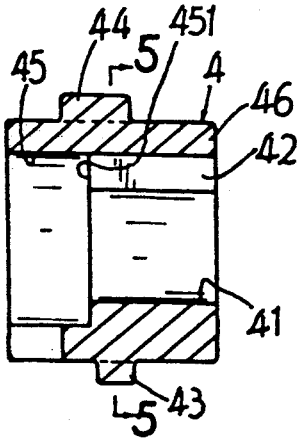
FIG. 4 is a longitudinal sectional drawing of a sleeve of the present invention.
Figure 5:
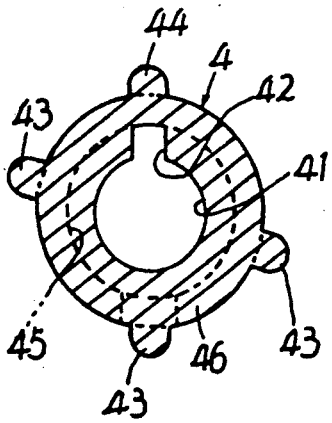
FIG. 5 is a right side view of the sleeve of FIG. 4.

Each sleeve 4 includes: an inner cylindrical sleeve hole 41 longitudinally formed in a central portion of the sleeve 4 engageable with the elongate bolt 21, an outer cylindrical hole 45 enlarged from the inner cylindrical sleeve hole 41 and facing the pivotal end portion 1*c* of the lock body 1, a protrusion notch 42 longitudinally recessed in the inner cylindrical sleeve hole 41 and communicating the outer cylindrical hole 45 for slidably engaging the protrusions 22 formed on the locking bolt 2, an annular shoulder portion 251 defined between the outer and inner cylindrical holes 45, 41, a plurality of sleeve teeth 43 annularly formed on the sleeve 4 for engaging the annular recesses 31 in the dial 3, an unique projection 44 having a length longer than that of each sleeve tooth 43 and operatively slid into the projection groove 14 of the lock body 1 to be locked by the projection groove 14 while the sleeve teeth 43 are rotatable in the inner cylindrical hole 32 in each dial 3 as shown in FIG. 1*c* for changing or resetting a combination of the padlock, and a bottom surface 46 formed on a bottom portion of each sleeve 4 with an innermost sleeve 4 adjacent to the second side portion 1*d* of the lock body 1 adapted to be pushed by the combination-changing means 6 held in the socket 13 of the lock body 1.

An outermost sleeve 4 adjacent to the first side portion 1*c* of the lock body 1 is retained by the bolt restoring spring 24 to urge the sleeves 4 inwardly towards the second side portion 1*d* of the lock body 1 for engaging each sleeve 4 with each dial 3.

The combination-changing means 6 (FIGS. 1, 2) held in the socket 13 of the lock body 1 includes: a cylindrical block 61 held in the socket 13 of the lock body 1 contacting a bottom surface 46 of a sleeve 4 adjacent to the second side portion of the lock body 1, a contracted cylindrical portion 62 protruding sidewardly in the fixed end portion 1*d* of the lock body 1 from the cylindrical block 61 to be held in a contracted hole 131 contracted from the socket 13, and a needle hole 63 recessed in the contracted cylindrical portion 62 from an outside surface of the cylindrical portion 62 at the fixed end portion 1*d* of the lock body 1, whereby upon an insertion of a needle or needle-like object into the hole 63 to depress the cylindrical block 61 inwardly to disengage the sleeves 4 from the dials 3 for a free rotation of the dials for re-setting a new combination.

For locking the present invention as shown in FIG. 1*a*, the dials 3 and the coupled sleeves 4 are rotated to a closed combination to disengage or deviate the protrusion notches 42 in the sleeves 4 from the protrusions 22 on the locking bolt 2 so that when it is intended to pivotally move the hasp 5 outwardly to unlock the hasp 5 from the fastening rod 16, the head portion 23 of the bolt 2 as urged by the inner portion of the hasp 5 will be retarded since the protrusions 22 of the bolt 2 have been obstructed by the annular shoulder portion 451 in each sleeve 4, thereby locking the bolt 2 and the hasp 5 at their locked state.

For unlocking the present invention as shown in dotted line of FIG. 1, the dials are rotated to an unlocked combination to match the sleeve notches 42 with the bolt protrusions 22, thereby allowing a pivotal opening movement of the hasp 5 of which the actuating recess portion 53 will bias the head portion 23 to retract the bolt 2 inwardly in the sleeve holes 41 for unlocking the padlock.

The present invention is superior to a conventional combination padlock because the hasp 5 is pivotally mounted in a side portion of the lock body and the hasp 5 can be pivoted sidewardly outwardly from a fastening member 16 secured to the lock body at a great opening angle so as for conveniently locking a staple or an object of larger volume in the hasp 5 and the fastening member 16. Meanwhile, the hasp 5 and the fastening member 16 provide no remarkable aperture therebetween to prevent an intentional breaking by an intruder for enhancing the security effect thereof.

Another preferred embodiment of the combination-changing means 6 is shown in FIGS. 1*b*–1*e*, which includes: a cylindrical block 61 held in the socket 13 of the lock body 1, a cylindrical portion 62 eccentrically formed on a bottom portion of the cylindrical block 61 having a diameter smaller than that of the cylindrical block 61 and a needle hole 63 recessed in the cylindrical portion 62 to be depressed by a needle outside the fixed end portion 1*d* of the lock body, and an eccentric extension 64 disposed in a half-circle bottom portion of the cylindrical block 61 normally held in an eccentric hole 131 formed in and smaller than the socket 13 (FIG. 1*e*), whereby upon an insertion of a needle into the needle hole 63 to depress the cylindrical block 61 inwardly and a rotation of the eccentric extension 64 to be engaged with a shoulder portion 132 defined between the socket 13 and the eccentric hole 131 as shown in FIG. 1c, the block 61 will be stably positioned and the sleeves 4 will be pushed inwardly to engage the projection 44 into the projection groove 14 to thereby be locked in position so that upon a rotation of the dials, the sleeves 4 as being "locked" will not be rotated to allow a free rotation of the dials 3 for re-setting a new combination.

I claim:

1. A combination padlock comprising:

a lock body having a hasp fastening member fixedly secured on a fixed end portion of the lock body;

a hasp pivotally mounted on a pivotal end portion of said lock body opposite to said fixed end portion lockable with said hasp fastening member;

a locking bolt longitudinally held in said lock body having a plurality of sleeves and dials rotatably mounted on said bolt with each said sleeve coupled with each said dial, said locking bolt normally resiliently biasing an inner portion of said hasp to pivotally close an outer portion of said hasp with said hasp fastening member about a pivot secured in said lock body for locking a padlock when said locking bolt is locked by said sleeves;

said lock body including: an upper shell combined with a lower shell, a locking bolt chamber recessed in the lock body from the pivotal end portion of the lock body for holding the locking bolt therein, a plurality of dial slots longitudinally formed in the lock body for operatively rotating the dials protruding outwardly from the dial slots, a socket for mounting a combination-changing means in the socket at the fixed end portion of the lock body opposite to the pivotal end portion, a plurality of projection grooves longitudinally recessed in the lock body each said projection groove juxtapositionally adjacent to each said dial slot, said hasp fastening member having an elongate rod perpendicularly secured to a base portion perpendicularly protruding upwardly from the lock body for operatively fastening the hasp to form a D shape confined by the hasp, the hasp fastening member, the base portion and the lock body, said pivot secured at the pivotal end portion of the lock body for pivotally mounting the hasp on the pivot, a rope hole formed in the lock body for connecting a plurality of padlocks by passing a rope through the rope hole, and a hasp hole formed in the pivotal end portion of the lock body for the pivotal movement of the hasp; said locking bolt including: an elongate bolt longitudinally formed in the lock body having a plurality of protrusions longitudinally formed and equally spaced on the elongate bolt, a head portion formed on one end of the elongate bolt adjacent to the pivotal end portion of the lock body, and a bolt restoring spring retained in the locking bolt chamber formed in the lock body for normally urging the head portion sidewardly outwardly towards the pivotal end portion of the lock body for biasing the hasp inwardly to be locked with the hasp fastening member; and said hasp formed with a pivot hole in its inner end portion for pivotally mounting the hasp on the pivot of the lock body, a hasp socket recessed in an outer end of the hasp for engaging a rod end portion of the hasp fastening member for locking the hasp with the hasp fastening member, and an actuating recess portion recessed in an innermost end portion of the hasp to be engageable with an extension block protruding outwardly from the head portion of the locking bolt; the actuating recess portion being a force point of a lever acted by the extension block of the head portion of the locking bolt, the pivot for engaging the pivot hole of the hasp being a fulcrum of the lever; and the hasp socket of the hasp being a weight of the "lever", whereby upon an outward forcing on the actuating recess portion as urged by the locking bolt and the restoring spring, the hasp socket of the hasp will be biased inwardly to engage the rod end portion of the hasp fastening member about the pivot for closing the hasp on the fastening member.

2. A combination padlock according to claim 1, wherein said combination-changing means includes: a cylindrical block held in the socket of the lock body, a cylindrical portion eccentrically formed on a bottom portion of the cylindrical block having a diameter of said cylindrical portion smaller than a diameter of said cylindrical block and a needle hole recessed in the cylindrical portion to be depressed by a needle outside the fixed end portion of the lock body, and an eccentric extension disposed in a half-circle bottom portion of the cylindrical block normally held in an eccentric hole formed in and smaller than the socket, whereby upon an insertion of a needle into the needle hole to depress the cylindrical block inwardly and a rotation of the eccentric extension to be engaged with a shoulder portion defined between the socket and the eccentric hole, the block will be stably positioned and the sleeve will be pushed inwardly to engage a projection of said sleeve into the projection groove in said lock body to thereby be locked in position so that the dials will be freely rotated for resetting a new combination.

* * * * *